US010738585B2

(12) United States Patent
Fredheim et al.

(10) Patent No.: US 10,738,585 B2
(45) Date of Patent: Aug. 11, 2020

(54) METHOD AND SYSTEM FOR PROCESSING A FLUID PRODUCED FROM A WELL

(71) Applicant: EQUINOR ENERGY AS, Stavanger (NO)

(72) Inventors: Arne Olav Fredheim, Trondheim (NO); Bjørgulf Haukelidsæter Eidesen, Stavanger (NO); Idar Olav Grytdal, Ranheim (NO); Ola Ravndal, Sandnes (NO)

(73) Assignee: EQUINOR ENERGY AS, Stavanger (NO)

( * ) Notice: Subject to any disclaimer, the term of this patent is extended or adjusted under 35 U.S.C. 154(b) by 74 days.

(21) Appl. No.: 15/760,430

(22) PCT Filed: Sep. 15, 2016

(86) PCT No.: PCT/NO2016/050187
§ 371 (c)(1),
(2) Date: Mar. 15, 2018

(87) PCT Pub. No.: WO2017/048132
PCT Pub. Date: Mar. 23, 2017

(65) Prior Publication Data

US 2018/0266229 A1 Sep. 20, 2018

(30) Foreign Application Priority Data

Sep. 15, 2015 (GB) ..... 1516323.1

(51) Int. Cl.
*E21B 43/01* (2006.01)
*E21B 43/36* (2006.01)
*B63B 25/14* (2006.01)

(52) U.S. Cl.
CPC ..... *E21B 43/36* (2013.01); *B63B 25/14* (2013.01); *E21B 43/01* (2013.01)

(58) Field of Classification Search
CPC ..... E21B 43/01; E21B 43/34; E21B 43/36; E21B 43/40
(Continued)

(56) References Cited

U.S. PATENT DOCUMENTS 4,645,522 A 2/1987 Dobrotwir
4,968,332 A * 11/1990 Maher ..... B01D 19/0042 55/385.4
(Continued)

FOREIGN PATENT DOCUMENTS

EP 0165343 12/1985
EP 1353038 10/2003
(Continued)

OTHER PUBLICATIONS

Russian Office Action dated Dec. 2, 2019 in corresponding Russian Patent Application No. 2018113431/11(021102) with English translation.
(Continued)

*Primary Examiner* — Kenneth L Thompson
(74) *Attorney, Agent, or Firm* — Wenderoth, Lind & Ponack, L.L.P.

(57) ABSTRACT

A method of processing a fluid produced from a well, the produced fluid being a high pressure fluid, the method comprising: reducing the pressure of the fluid to a reduced pressure such that a gas phase and a liquid phase are formed; separating the gas phase from the liquid phase thus forming a gas product and a liquid product; and storing the liquid product in a storage tank at a pressure such that the liquid product remains in a stable liquid phase during storage, wherein the reduced pressure is greater than atmospheric pressure.

14 Claims, 2 Drawing Sheets

(58) Field of Classification Search
USPC ..... 166/357
See application file for complete search history.

(56) References Cited

U.S. PATENT DOCUMENTS

| | | | | |
|---|---|---|---|---|
| 6,094,937 | A | 8/2000 | Paurola et al. | |
| 8,273,151 | B2 * | 9/2012 | Miotto | B01D 19/0036 95/24 |
| 2002/0053573 | A1 | 5/2002 | Bowen et al. | |
| 2015/0300146 | A1 * | 10/2015 | Grave | E21B 43/36 166/368 |
| 2018/0345176 | A1 * | 12/2018 | Roberts | B01D 19/0036 |

FOREIGN PATENT DOCUMENTS

| | | |
|---|---|---|
| GB | 2186238 | 8/1987 |
| GB | 2186283 | 8/1987 |
| GB | 2222961 | 3/1990 |
| GB | 2318306 | 4/1998 |
| WO | 98/01335 | 1/1998 |
| WO | 98/17941 | 4/1998 |
| WO | 00/57102 | 9/2000 |
| WO | 2015/082543 | 6/2015 |

OTHER PUBLICATIONS

International Search Report dated Dec. 12, 2016 in International Application No. PCT/NO2016/050187.
Written Opinion of the International Searching Authority dated Dec. 12, 2016 in International Application No. PCT/NO2016/050187.
Patents Act 1977: Search Report under Section 17(5) issued by the UK-IPO dated May 4, 2016 in corresponding Great Britain Application No. 1516323.1.

* cited by examiner

METHOD AND SYSTEM FOR PROCESSING A FLUID PRODUCED FROM A WELL

The present invention relates to a method and system of processing a fluid produced from a well, preferably a hydrocarbon well.

The processing and transporting of fluids produced from subsea wells is important in the field of oil and gas. With regard to gas-condensate fields, it is common practice to separate produced water from produced hydrocarbons at an offshore location and to dispose of the water for example by injecting in a subsea well. Further, it is common practice to separate produced liquid hydrocarbons, i.e. the condensates and liquid petroleum gas (LPG), from the natural gas in the produced hydrocarbons at an offshore location. The separated natural gas is typically transported back onshore via a pipeline. The liquid hydrocarbons are fully stabilised offshore such that they are in a stable liquid phase at atmospheric pressure. This stabilisation is done by reducing the pressure in multiple stages so as to form gas and liquid phases, and separating the evaporated gas from the liquid at each reduced pressure. Once the pressure is reduced to atmospheric pressure and ambient atmospheric temperature (e.g. around 30-40° C. and 1 bar) and the evaporated gas has been removed, the remaining liquid is in a stable liquid phase at atmospheric pressure and ambient temperature and so can be stored at atmospheric pressure and ambient temperature. The fully stabilised liquid hydrocarbons are gathered and stored at atmospheric pressure and ambient temperature at the topside and are transported back onshore at atmospheric pressure using a vessel.

In one aspect the invention provides a method of processing a fluid produced from a well, the produced fluid being a high pressure fluid, the method comprising: reducing the pressure of the fluid to a reduced pressure such that a gas phase and a liquid phase are formed; separating the gas phase from the liquid phase thus forming a gas product and a liquid product; and storing the liquid product in a storage tank at a pressure such that the liquid product remains in a stable liquid phase during storage, wherein the reduced pressure is greater than atmospheric pressure.

When fluid is produced from a subsea well, the fluid is typically a very high pressure liquid. The liquid can comprise components that are stable liquids at atmospheric conditions (e.g. at atmospheric pressure and temperature) and components that are gaseous at atmospheric conditions. It may be necessary to process the produced fluid in order to extract the maximum amount of useful products from the fluid and to ease transportation of the products from the offshore location. In the present method, this processing includes reducing the pressure of the fluid to a reduced pressure that is greater than atmospheric pressure and storing the separated fluid under pressure. The pressure of the fluid (i.e. the gas/liquid mixture) at the separation step is greater than atmospheric conditions. The pressure of the fluid at the separation step may be the pressure to which the fluid is reduced in order to form the gas and liquid phases (i.e. the "reduced pressure" of claim 1), i.e. it should be understood that the reduced pressure is the lowest pressure at which the separation of the gas phase and the liquid phase occurs.

An unstable liquid product is a liquid that is in an unstable liquid phase. Such a liquid may be at temperature and pressure conditions such that at least one component of the liquid may be able to evaporate. In the field of oil and gas, such unstable liquids may be undesirable since evaporating liquids can lead to highly flammable gaseous hydrocarbons being present, which may be dangerous. For these reasons, it is undesirable to transport unstable liquid products. Typically, the produced fluid from a well, if it were brought to atmospheric conditions, would be a highly unstable liquid due to having large natural gas components.

It is known in the art to fully stabilise unstable liquid products, such as fluid produced from a well, for storage prior to transportation away from the well. Full stabilisation is achieved by decreasing the pressure of the produced fluid to atmospheric pressure and separating the separated gas and liquid phases. A fully stabilised liquid is one that is in a fully stable liquid phase at atmospheric conditions, i.e. it will not evaporate at atmospheric pressure and ambient atmospheric temperature, i.e. its vapour pressure at ambient temperature is below atmospheric pressure. Such fully a fully stabilised liquid can then be transported to another location, e.g. onshore, at atmospheric conditions and it will remain stable.

In the present method, the liquid product that is created and stored under pressure may be considered to be a semi-stable liquid product. The term "semi-stable" herein is used to describe a liquid that has been stabilised to a certain extent, but has not been fully stabilised. In the present method, the liquid product has been stabilised only to a certain extent because during the pressure-reducing and separating steps, the pressure is reduced to a pressure that is greater than atmospheric pressure. Thus, the semi-stabilised liquid product is only in a stable state if it is stored at a pressure over a certain pressure level, i.e. greater than atmospheric pressure, as defined in the present method. Thus, for the present method, a semi-stable liquid product may be a liquid product that is only in a stable state due to it being under elevated pressure, at ambient temperature or above. The semi-stable liquid comprises some, but not all, of the gas components of the produced fluid.

Creating and storing such a semi-stable liquid product is advantageous since the amount of processing of the produced fluid in the vicinity of the well (e.g. prior to transportation) is reduced. The inventors have realised that there is no need to create a fully stabilised liquid product prior to transportation of the liquid product away from the well. Rather, pressurised transportation means can be used. Such pressurised transportation means may be known in the art, as discussed below. Thus, the inventors have found that only a semi-stabilised liquid product needs to be created in the vicinity of the well prior to transportation. Producing a semi-stabilised product requires fewer processing steps and less equipment than producing a fully stabilised product. Thus the amount of equipment required in the vicinity of the well to create a liquid product that is capable of being safely transported can be reduced. This is particularly advantageous when the well is offshore.

Further, when the liquid product is created by separating it from a gas in the produced fluid, since the liquid product is stored separately from the gas, the gas product can be piped away during the process in a purely gas pipeline. This pipeline may not require any heating or inhibition, as was required in the prior art e.g. in order to avoid hydrates forming, since there is no longer any liquid passing through the pipeline.

The produced fluid at the well may typically have a pressure of approximately 100 bar or approximately 1000 bar, preferably 100-1000 bar, preferably 200-1000 bar, such as greater than 100 bar, 200 bar, 300 bar, 400 bar or 500 bar. The precise pressure is site-specific.

By "bar" in the present application, it is meant absolute pressure.

The reduced pressure may be approximately 1 to 20 bar, preferably 5 to 10 bar preferably 5 bar. The liquid product may be stored at between approximately 1 to 20 bar, preferably 5 to 10 bar, preferably 5 bar. Thus, the liquid product may be created such that it has a vaporisation pressure of between approximately 1 to 20 bar, preferably 5 to 10 bar, preferably 5 bar. This is preferable since the liquid product is stabilised using a pressure of between approximately 1 to 20 bar, preferably 5 to 10 bar, preferably 5 bar, and hence a standard LPG carrier can be used to transport the liquid product back to shore in a semi-stabilised state (standard LPG carriers can maintain a pressure of up to 5.5 bar, and fully pressurised LPG carriers up to around 18 or 20 bar).

The reduced pressure may be significantly greater than atmospheric pressure (around 1 bar). The reduced pressure may be sufficiently low such that it can be stored and/or transported safely using standard or fully pressurised LPG carriers. It is advantageous to have the reduced pressure being significantly above atmospheric pressure, since the higher the reduced pressure is the less processing is required offshore.

For example, the reduced pressure may be greater than 2 bar, preferably greater than 3 bar, preferably greater than 4 bar, preferably greater than 5 bar, preferably greater than 10 bar. The liquid product may be stored at greater than 2 bar, preferably greater than 3 bar, preferably greater than 4 bar, preferably greater than 5 bar, preferably greater than 10 bar. Thus, the liquid product may be created such that it has a vaporisation pressure greater than 2 bar, preferably greater than 3 bar, preferably greater than 4 bar, preferably greater than 5 bar, preferably greater than 10 bar.

Additionally/alternatively, the reduced pressure may be less than 30 bar, preferably less than 20 bar, preferably less than 15 bar, preferably less than 10 bar. The liquid product may be stored at less than 30 bar, preferably less than 20 bar, preferably less than 15 bar, preferably less than 10 bar. Thus, the liquid product may be created such that it has a vaporisation pressure less than 30 bar, preferably less than 20 bar, preferably less than 15 bar, preferably less than 10 bar. The liquid product in the present invention may consist of all the components in the produced fluid that are liquid at atmospheric conditions (e.g. atmospheric pressure and ambient temperature). These components are referred to hereinafter as "liquid components". Every liquid component of the produced fluid may be in the liquid product. The liquid product may also comprise some of the gas components of the produced fluid that are stable liquids at the pressure and temperature under which the liquid product is stored. The liquid product may be the portion of the produced fluid that is stored as a liquid in the present method. The gas product may the portion of the produced fluid that is separated from the liquid portion during the separation step.

The method may comprise: transferring the liquid product from the storage tank to a liquid transporter, wherein the transferring occurs at a pressure such that the liquid product remains in a stable liquid phase during transfer; and transporting the liquid product to another location using the liquid transporter, wherein the transporting occurs at a pressure such that the liquid product remains in a stable liquid phase during transport.

Thus, the method may provide a chain of fluid production steps from fluid production, to semi-stable liquid product storage under pressure in the vicinity of the well, to transportation of the semi-stable liquid product under pressure to another location distant from the well. This allows safe and efficient handling of the produced fluid.

The pressure-reducing step, the separation step, the storage step and/or the transport step may be performed in the vicinity of the well. By the "vicinity" of the well, it is meant the area around well that is close enough such that a long-distance transporting means (such as a vessel) is not required. The vicinity of the well may be considered to be the area around the well that the produced fluid can be efficiently and safely transported through standard conduits, such as risers, pipelines and/or spools.

These steps may be performed within 10 m, 50 m, 100 m or 1000 m of the well.

Further, if a pipeline is used to connect the well to the processing/storage equipment for the present method, the processing equipment may be located up to 50 km, up to 40 km, up to 20 km, up to 10 km or up to 5 km from the well. The produced fluid may be transported from the well to the processing and storage equipment (which may be considered to be a processing facility) in a pipeline. The pipeline may be high pressure and/or temperature (e.g. substantially at the pressure and temperature of the produced fluid exiting the well, though the pressure and temperature of the fluid in the pipe may decrease slightly over distance). This is still intended to be within the "vicinity" of the well.

The processing/storage equipment for the present method may be placed within the range of numerous wells, which all feed into the same processing equipment.

The other location may be distant from the well. The other location may be an onshore location. By distant it is meant a location that is far enough from the well such that a long-distance transporting means (such as a vessel) is required. The other location may be at least 10 km, 50 km, 100 km, 500 km or 1000 km away from the well.

The liquid transporter may be a vessel. The liquid transporter may be an LPG carrier, such as an LPG vessel. The liquid transporter may be capable of transporting the pressurised liquid product. The liquid transporter may be capable of transporting the pressurised liquid product at between approximately 1 to 10 bar, preferably 5 to 10 bar, preferably 5 bar. Existing liquid transporters may be capable of transporting pressurised liquids of up to 18 to 20 bar. In the future liquid transporters that may be able to transport up to 50 bar or more may become available.

The liquid transporter may be a fully pressurised or partially pressurised liquid transporter, such as a standard or fully pressurised LPG vessel. The liquid product created by the separation step may therefore have been created such that it is capable of being stabilised under pressure in a standard LPG vessel. It should be understood that the pressure at which the liquid product will be stabilised will depend on the pressure at which the separation of the gas phase and the liquid phase occurs. It is this pressure that is selected so as to form a liquid product with the correct stabilisation pressure.

The method may comprise: transferring the liquid product to the other location, wherein the transferring occurs at a pressure such that the liquid product remains in a stable liquid phase during transfer; and reducing the pressure of the liquid product to atmospheric pressure.

Thus, the method may provide a chain of steps from fluid production to processing the liquid product at a location distant from the well. In the prior art, a liquid product at atmospheric pressure is typically produced in the vicinity of the well, e.g. at an offshore location. The present invention allows for this step to occur at a different location, thus reducing the need for equipment in the vicinity of the well. This is particularly advantageous when the well is offshore, as the other location may be an onshore location. It is preferable to do as little processing as possible offshore, and as much as possible onshore, since it reduces the need for offshore personnel and equipment, which is more expensive and less efficient.

The pressure of the liquid product may be maintained at around 5 to 10 bar or more in the storage, transfer and/or transporting step(s). After the separation step, the pressure of the liquid product may be maintained at least at the pressure at which the separation occurred. This ensures that no further gas components evaporate from the liquid product.

During any or all of the separating, storing, transferring and/or transporting steps, the pressure may be maintained at a pressure approximately equal to or greater than the reduced pressure. This prevents the separated liquid product becoming unstable. Stated differently, during and throughout any or all of the separating, storing, transferring and/or transporting steps, the pressure may not fall below the reduced pressure.

During any of the separating, storing, first transferring, transporting, and second transferring steps, the temperature and the pressure of the liquid product are maintained at values such that the liquid product remains in a stable liquid phase. The temperature may vary depending on ambient temperature conditions of the local environment (e.g. when the liquid product is subsea the temperature may be different compared to when it is topside, due to varying ambient temperatures). What is important is that the pressure is high enough such that, at whatever temperature of the liquid product, the semi-stabilised liquid product is in a stable liquid phase.

During either temperature control or pressure control steps, both the pressure and the temperature may vary. Thus, if pressure is altered, the temperature may need to be controlled too, and vice versa.

The temperature of the produced fluid and/or liquid product may be maintained such that it is above the hydrate temperature of the produced fluid and/or liquid product. The hydrate temperature may depend on the composition of the fluid/liquid in question, the pressure etc.

The fluid and/or liquid product may be cooled to a temperature between the well temperature and the temperature of the surrounding environment (e.g. the surrounding seawater, when the method is performed subsea) or the hydrate temperature of the fluid/liquid product.

The temperature of the produced fluid and/or liquid product may be maintained at above around 20° C., 30° C., 40° C. or 50° C.

The temperature of the produced fluid may vary throughout the process, or may be maintained substantially constant.

The liquid product may comprise all liquid components present in the produced fluid from the well. The liquid product may comprise liquid hydrocarbons and water. The liquid product may comprise oil and water. The liquid product may comprise condensate and water. The liquid product may comprise condensate, water and/or LPG. The liquid product may comprise water. There may be up to 5% by volume, or more, of water in the fluid. There may be more than 1%, 2%, 3%, 4%, 5%, 10%, 15%, 20%, 30%, 40% or 50% (by volume) of water in the liquid product. The liquid product may consist of liquid hydrocarbons and water. The liquid product may consist of oil and water. The liquid product may consist of condensate and water. The liquid product may consist of condensate, water and/or LPG. The liquid product may comprise some of the gas components of the produced fluid, e.g. those that are stable liquids at the pressure and temperature under which the liquid product is stored. The liquid product may comprise (or consist of) all the components of the produced fluid that are stable liquids at the pressure and temperature under which the liquid product is stored.

The water may be produced water and/or water dissolved in the hydrocarbons.

Thus, the liquid product outputted from the present method may comprise (or consist of) exactly the same liquid components (i.e. the components of the produced fluid that would be stable liquids at atmospheric conditions) present in the produced fluid from the well.

In the prior art, to treat the liquid components of a produced fluid, much equipment in the vicinity of the well, e.g. offshore, is required. Because the present method allows for the outputted liquid product to comprise (or consist of) all of the liquid components in the produced fluid, the need for processing equipment in the vicinity of the well is reduced. Instead, the liquid product can be processed distant from the well, e.g. onshore.

For example, in the prior art, the liquid hydrocarbons and the water in the produced fluid would be separated in the vicinity of the well, e.g. at an offshore location. The water could then be discarded by injecting it into a well, for example. The liquid hydrocarbons could then be fully stabilised, by performing the separation at atmospheric conditions, and transported from the vicinity of the well, e.g. back onshore. In the present method, however, the liquid product can comprise the water too. The inventors have surprisingly found that it can be advantageous not to separate the liquid hydrocarbons from the water prior to transportation, and hence have found it advantageous to include water in the stored (and transported) liquid product. This is advantageous since it reduces the need for further separation equipment in the vicinity of the well, e.g. offshore. This is surprising since it would be expected to be disadvantageous to have water in the liquid product, since it is normally not desired for water to be transported long distances, e.g. back onshore.

In the present method, processing the semi-stabilised liquid product at the location distant from the well may comprise separating the liquid hydrocarbons from the liquid water in the liquid product. This may be achieved using a fourth separator.

Additionally/alternatively, processing the semi-stabilised liquid product at the location distant from the well may comprise fully stabilising the liquid product by reducing the pressure of the liquid product to atmospheric pressure, thus generating a gas phase and a liquid phase, and separating the gas phase from the liquid phase. This separated liquid phase is thus a fully stabilised liquid product. Thus, at this stage, the pressure under which the liquid product is being kept may be reduced to atmospheric pressure. The fully stabilised liquid product can then be stored and processed in any standard techniques/equipment known in the art.

In this manner, the present method allows for fully stabilised liquid hydrocarbons to be obtained at a location distant from the well, e.g. onshore, without having to separate water from the liquid hydrocarbons or fully stabilise the liquid product at the well. This effectively means that some of the processing steps in the prior art that occurred in the vicinity of the well, e.g. offshore, can now be carried out onshore, e.g. onshore.

The produced fluid from the well may comprise a gas component and a liquid component. Typically the produced fluid may comprise, or consist of, gaseous hydrocarbons, liquid hydrocarbons and water. The liquid hydrocarbons may be oil and/or may be condensates and/or LPG. The gas component of the produced fluid may be in a condensed or dissolved liquid phase in the produced fluid due to the very large pressure present at the well. The term "gas component" should be understood to mean a component of the produced fluid that would be gaseous under atmospheric conditions, e.g. atmospheric pressure and ambient atmospheric temperature.

The present method is particularly advantageous for use on gas-condensate fields, where the fluid produced from the well typically comprises light liquid hydrocarbons, such as condensates, and gaseous hydrocarbons, with a small amount of water. The present method may also be used for oil fields where the produced fluid comprises oil, with or without gaseous hydrocarbons and/or water.

The condensate may be a natural gas condensate.

The method may comprise separating the gas component of the produced fluid from the liquid component of the produced fluid; and creating an unstable liquid product from the liquid component by reducing the pressure of the liquid component.

The pressure-reducing step and the separating step of the method may comprise reducing the pressure of the produced fluid to a first reduced pressure such that a first gas phase and a first liquid phase are formed. This reduction of pressure may be considered to have formed an unstable liquid, from which some of the gas component evaporates. The method may comprise separating the first gas phase from the first liquid phase to form a first gas product and a first liquid product, and further reducing the pressure of the first liquid product to a second reduced pressure such that a second gas phase and a second liquid phase are formed. This reduction of pressure may be considered to have formed another unstable liquid, from which more of the gas component evaporates. The method may comprise separating the second gas phase from the second liquid phase to form a second gas product and a second liquid product. The second liquid product may be the stored liquid product. The first reduced pressure may be greater than the second reduced pressure and the second reduced pressure may be greater than atmospheric pressure.

The second gas product may be combined with the first gas product and/or combined with the produced fluid.

The first reduced pressure may be the processing pressure of the processing equipment. The first reduce pressure may be 20 to 100 bar, preferably 50 to 70 bar. Reducing the pressure to such a pressure allows some of the gas components to be separated in the first separating step, and means that the processing equipment (e.g. the separators etc.) does not need to be able to handle the high pressure of the fluid at the well (which can be 100 s or 1000 s bar).

The second reduced pressure may be the desired pressure of the semi-stable liquid product discussed above, e.g. a pressure low enough such that standard liquid transporters can be used, such as approximately 1 to 10 bar, preferably 5 to 10 bar, preferably 5 bar.

The pressure-reducing step and the separating step may also comprise reducing the temperature of the first gas product to a reduced temperature such that another gas phase and another liquid phase are formed; and separating these gas and liquid phases from the second liquid phase to form another gas product and another liquid product, wherein this liquid product may be combined with the first and/or second liquid product, the combined liquid products being stored in the storage tank.

Thus, the separating step may comprise multiple separating steps. The pressure-reducing step and the separating step may comprise one or more further pressure-reduction and separating steps prior to the storage step. Using multiple steps helps to ensure that all possible gas components are removed from the liquid product so that the liquid product is truly stable when it is stored at the relatively low storage and transport pressures.

Since it is at an elevated pressure, the stored liquid product may comprise a portion of the gas component of the produced fluid.

The pressure may be reduced using a valve, such as a choke, or an expander.

The temperature of the fluid/liquid may be reduced when the pressure is reduced. The pressure may be reduced adiabatically. The pressure may be reduced isothermally.

The liquid and gas phase(s) may be separated using one or more separators. The separator may separate the gas in the produced fluid from the liquid in the produced fluid. The separator may separate gaseous hydrocarbons and/or gaseous water from liquid hydrocarbons and/or liquid water. The gaseous hydrocarbons may comprise natural gas and/or petroleum gas. The liquid hydrocarbons may comprise oils, light oils and/or condensates.

The separator may be connected to the well via a spool, such as a rigid or flexible spool. The separator may be connected to a production riser connected to the well via a spool, such as a rigid or flexible spool. The separator may be connected to the storage tank via at least one spool, such as a rigid or flexible spool. The separator may be connected to any possible subsequent or preceding separator via a spool, such as a flexible or rigid spool.

Prior to entering the separator, the produced fluid may have been pre-cooled and/or may have had sand/mud removed from it, which may have occurred subsea or topside. This may improve the separation of natural gas and petroleum gas from condensates and water. The pre-cooling may occur before or after the pressure-reduction step. The produced fluid may be the pure well stream.

The method may comprise cooling the produced fluid. This may occur before or after the pressure-reduction step. This may occur before the separation step. The produced fluid at the well may typically be at high temperature, e.g. 50 to 200° C. or 100 to 150° C. The produced fluid may be cooled to a lower temperature, preferably around the ambient atmospheric temperature, preferably around 10 to 50° C., preferably around 20 to 40° C., preferably 30° C. This may be referred to as the processing temperature.

Once cooled, the pressure-reduction step(s) and separation step(s) of the liquid product may proceed substantially isothermally. Alternatively, the liquid product may be cooled prior to each separation step to continually lower the temperature of the liquid product toward ambient temperature. This may occur before, during or after the respective pressure-reducing step.

Preferably, the temperature of the liquid product in the (final) separation step (e.g. the separation step before the storage step) may be approximately ambient temperature, and preferably above ambient temperature, such as 30° C. or 40° C. Having this temperature around, or slightly above, ambient temperature means that the semi-stable liquid produced will remain semi-stable, if it is maintained pressurised, without it being required to be cooled during storage and transport. If the (final) separation step occurred at a temperature below the ambient temperature and if the liquid product subsequently warmed to the ambient temperature, the semi-stabilised liquid may become unstable. This is avoided if the (final) separation step occurs at ambient, or above ambient, temperature.

By selecting the temperature and pressure at which the separation occurs, both the hydrocarbon dew point of the gas product and the pressure/temperature at which the liquid product is stable can be controlled.

The separator may be a first separator.

The separated gas product may pass to a second separator, preferably via a cooler. The cooler and/or second separator may act to purify natural gas by condensing any remaining water or petroleum gas out of the gas product. The gas may be cooled to approximately the ambient temperature of the environment surrounding the second separator (e.g. the temperature of the sea water) and preferably to below the hydrate temperature. The temperature is selected depending on the required specification of the gas product. The cooled gas product (which may now comprise a gas phase and a liquid) may then pass through the second separator to separate the condensed liquid from the gas. The condensed (liquid) water and condensed (liquid) petroleum gas can be fed into the separated liquid phase output from the first separator. The condensed liquid water and liquid petroleum may be fed into the separated liquid component output from the first separator. The condensed liquid water and liquid petroleum gas is preferably fed into the separated liquid component upstream of the third separator (see below). Alternatively, however, the condensed liquid can be fed into the separated liquid component downstream of third separator (see below).

The cooler and/or separator may be connected to the first separator via a spool, such as a rigid or flexible spool.

When the method is performed subsea, a gas riser may be connected to the gas output of the first separator and/or the cooler and/or the second separator for transporting the gas product from the seabed to the surface, e.g. to a platform such as an unmanned wellhead platform.

The cooler and/or the second separator may be connected to the liquid output of the first separator via a spool, such as a rigid or flexible spool.

The cooler may be an active cooler or a passive cooler. The conduit(s), pipeline(s) and/or spool(s) may also be used for cooling, i.e. transporting the fluid over a certain distance to at least help achieve the required temperature using the ambient temperature of the surround environment (such as sea water) for cooling.

As discussed above, the separated liquid component output from the first separator may have any remaining gas (e.g. natural gas) removed from it, preferably using a third separator. It should be noted that the label "third" here does not necessarily imply that the second separator (see above) is present, e.g. when the second separator is not present it may be clearer to consider the third separator as a second separator. This may be achieved by reducing the pressure of the separated liquid component, e.g. using a choke or expander, to allow the gas to evaporate. The pressure may be reduced to between approximately 1 to 10 bar, preferably 5 to 10 bar, preferably 5 bar. This gas may then be separated from the liquid using the third separator. This gas can be fed into the separated gas product output from the first separator, preferably downstream of the cooler and/or second separator. This gas can be fed into the separated gas product output from the first separator using an ejector, which may be a two or three-set ejector. An ejector may be needed because the gas separated using the separator may be at a higher pressure than the remaining gas removed from the liquid component because the liquid component may have undergone further pressure-reduction step(s) in comparison to the gas product output from the first separator. An ejector uses the energy within a higher pressure fluid stream (the separated gas component) to entrain and compress a low pressure fluid stream (the remaining gas removed from the liquid component) to an intermediate pressure. Alternatively or additionally, a compressor may be used.

The gas removed using the third separator may be fed into the separated gas component output from the first separator upstream of the second separator and/or the cooler.

The gas removed using the third separator may be fed into the cooler and/or the second separator.

The gas removed from the third separator may be fed into the produced fluid upstream of the first separator.

The gas removed using the third separator may be compressed (which may be considered a recompression) into the (high pressure) gas stream output from the first separator.

In any of these options it may be necessary to increase the pressure of the gas removed from the third separator. This may be done by using a compressor. Alternatively, it may be done using ejector(s), whereby at least a portion of the gas output from the first separator, the cooler, the second separator and/or a compressor downstream of the second separator, is used by the ejector(s) to increase the pressure of the gas removed from the third separator. The remainder of the gas product output from the first separator, the cooler, the second separator and/or the compressor downstream of the second separator may proceed to gas transport and/or drying.

The gas product downstream of the first separator, and preferably downstream of the cooler, the second separator, the compressor and/or ejector, may pass to a conduit to take it onshore, or back to a host, or to a drying system, or to a (subsea) compressor, or to a riser, or to a platform. The gas product may be in a transportable state such that it can be transported long-distance, or may require further processing. After separation from the liquid component, the gas component may be compressed and/or cooled.

Separating the gas component from the liquid component, and storing the liquid component, as discussed above is advantageous as it allows the gas only to be transported away from the well, Typically, all products in the produced fluid stream are transported away from the well. In a subsea well, if all of the produced fluid is transported to the topside, due to the liquid component being present, there is a huge pressure loss due to a large static head. Separating and storing the liquid component, preferably subsea, removes this large pressure loss in the gas being transported topside. Thus, the well can be operated at a lower pressure by separating and storing the liquid component subsea. Thus, the method may comprise sending the gas product to a topside location and maintaining the liquid product at a subsea location.

The pressure of the liquid component may be reduced using the choke or expander valve as discussed above. Additionally/alternatively, a heating means could be used.

After the separation step, the liquid product may pass through a heat exchanger, preferably a cooler, and/or a pump and into the storage tank. The heat exchanger may be connected to the (first) separator or the choke or expander or the third separator via a spool, such as a rigid or flexible spool. The heat exchanger may be an active or passive heat exchanger, preferably an active or a passive cooler. The temperature of the stored fluid may be between the well temperature and the temperature of the ambient surroundings (e.g. sea water, when the tank is subsea), or around the temperature of the ambient surroundings. The temperature may be around 30° C. or 40° C.

The temperature of the liquid product is selected/controlled depending on the pressure at which it is stored (which may be related to the depth of the sea) or the pressure at which it is to be transported and the liquid product properties (such as composition). The temperature may be between the ambient temperature of the environment surrounding the storage tank and the temperature at which hydrates in the liquid product would form.

The liquid product may be transferred from the storage tank to the transporter using a pump. Preferably, however, the transfer may occur passively. Passive transfer can be achieved by using the increased pressure of the liquid product in the storage tank to transfer the liquid product. For example, when the storage tank is subsea and the transporter is on the sea surface, the hydrostatic pressure at the storage tank location can be used to transfer the liquid product to the transporter.

The storage tank may comprise a bladder-type storage tank, such as the Kongsberg storage tank. The storage tank may comprise a concrete storage tank.

The storage tank may have a volume between approximately 1000 $m^3$ and 50000 $m^3$, preferably between approximately 5000 $m^3$ and 10000 $m^3$, and preferably approximately 7500 $m^3$. These volumes are preferable so as to allow for several days or weeks of production from the well before the storage tank is full. Further, these volumes may approximately match the volume of a typical transporter, such as an LPG vessel. Although, if the volume of the storage tank exceeds the volume of the transporter, then simply multiple trips and/or multiple transporters may be used to empty the tank. The volume of a typical transporter may be between approximately 1000 $m^3$ and 30000 $m^3$, preferably between approximately 5000 $m^3$ and 25000 $m^3$, and preferably approximately 22500 $m^3$.

As the liquid product is stored in the storage tank, the liquid water may become separated from the liquid hydrocarbons over time. The liquid water will tend to sink and the liquid hydrocarbons will tend to float in the tank. This separation can be used to further purify the liquid hydrocarbons in the liquid product by removing the water. For instance, when the liquid product is transferred from the storage tank to the transporter, relatively pure liquid hydrocarbons may be transferred into a first location (e.g. a first tank) in the transporter (or into a first transporter) and the separated water into a second location (e.g. a second tank) in the transporter (or into a second transporter). Such a method can also be used to separate hydrocarbons of different densities. If the conduit for transferring the liquid is attached to the top of the tank, the lighter liquid (e.g. liquid hydrocarbons) may be transferred out of the tank first and the heavier liquid (e.g. water) may be transferred out of the tank second. If the conduit for transferring the liquid is attached to the bottom of the tank, the heavier liquid (e.g. water) may be transferred out of the tank first and the lighter liquid (e.g. liquid hydrocarbons) may be transferred out of the tank second. Thus, preferably, the conduit for transferring the liquid from the storage tank to the transporter is connected to the top or to the bottom of the tank.

The storage tank may preferably be located subsea, such as on the sea bed. This is advantageous, since the hydrostatic pressure of the surrounding sea water can act to pressurise the liquid component and hence semi-stabilise it as it is stored. Further, placing the storage tank on the sea bed reduces the need for large surface structures, which can be particularly useful if an unmanned wellhead platform is desired. The bladder-type storage tank may be particularly advantageous because the liquid component can be transferred out of the bladder-type storage tank by using the hydrostatic pressure of the surrounding sea, as is known in the art. Further, locating the storage tank on the sea bed, in comparison to having the storage tank topside, may reduce the differential pressure between the inside and outside of the tank, and so may reduce the stress on the tank walls. Thus, advantageously there is less need for the tank to be able to handle large pressure differentials.

Alternatively, however, the storage tank could be provided on the sea surface. For example, the storage tank could be an LPG vessel, preferably one that is stationary (e.g. moored or anchored near the well) and preferably retrofitted accordingly to act as a suitable storage tank.

At least part of the pressure-reducing and/or separating steps may be performed at a subsea location, such as the seabed. For instance, the (first) separator, the cooler, the second separator, the choke or expander, the heat exchangers, and/or the third separator may be located subsea. Performing the separating step subsea reduces the need for large surface structures, which can be particularly useful if an unmanned wellhead platform is desired. Alternatively/additionally, at least part of the pressure-reducing and/or separating steps may be performed at a topside location.

Thus, the pressure-reducing, separating and the storing steps of the present method may be performed offshore. The storing step may comprise storing the pressurised semi-stabilised liquid component at a subsea location. The liquid product may be pressurised (e.g. maintained under pressure) using the pressure of the environment surrounding the storage tank. When the storage step is performed offshore, the sea itself can be used to provide the pressure for storing the liquid product. Thus, the present inventors have recognised that the local environment of an offshore production well can be used to stabilise a semi-stabilised liquid product of the produced fluid.

Further, the heat exchanger and/or pump may be located subsea. Alternatively, these components may be located at a topside location.

The ejector and/or compressor may preferably be located subsea, but may be located topside.

At least some of all the components discussed in relation to the pressure-reducing, separating and storing steps may preferably be located subsea, but may be located topside.

Performing the storage, and the other method steps, may occur at a depth from around 50 m to 10000 m, preferably around 70 m to 1000 m. These depths may provide the optimum pressure for creating and storing the semi-stabilised liquid product.

The ejector may be mounted on the (first) separator. The choke or expander may be mounted on the (first) separator. The choke or expander may be mounted on the cooler. The ejector may be mounted on the cooler. The choke or expander may be mounted on the second separator. The ejector may be mounted on the second separator. The choke or expander may be mounted on the third separator. The ejector(s) and/or compressor(s) may be mounted on the third separator. The choke or expander may be mounted on the heat exchanger. The (first) separator, the cooler, the second separator, the ejector(s) and/or compressor(s), the choke or expander, the third separator and/or the heat exchanger may be physically attached to each other in one integral unit. The pump may be mounted to the storage tank, or may be separate from the storage tank. The (first) separator, the cooler, the second separator, the ejector(s) and/or compressor(s), the choke or expander, the third separator, the heat exchanger and/or the pump may by mounted to the storage tank, or may be separate from the storage tank. Alternatively at least some of these components may be connected via spools, as discussed above. The spools may by approximately 50 m in length.

At least some of the components discussed in relation to the method above may form part of a processing facility. The processing facility may be located subsea.

The first, second, third or fourth separator may be horizontal separator, a vertical separator, a spherical separator, a scrubber, a cyclone scrubber, a gas-liquid cylindrical cyclone separator (GLCC) or the separating apparatus shown in WO 2015/118072. In another aspect, the invention provides a system for processing a fluid produced from a well, the produced fluid being a high pressure fluid, the system comprising: means for reducing the pressure of the fluid to a reduced pressure such that a gas phase and a liquid phase are formed; means for separating the gas phase from the liquid phase thus forming a gas product and a liquid product; and a storage tank for storing the liquid product at a pressure such that the liquid product remains in a stable liquid phase during storage, wherein the reduced pressure is greater than atmospheric pressure.

In general, the system may be any system capable of performing any of the above-discussed methods, and may comprise any of the above-discussed features.

The separating means may be any means capable of doing so, such as one or more separators, coolers, pumps and/or heat exchangers.

The pressure reducing means may be any means capable of doing so, such as one or more expanders or chokes or valves.

The system may comprise: a transfer means for transferring the liquid product from the storage tank to a liquid transporter; and a liquid transporter for transporting the liquid product to another location using the liquid transporter, the transfer means and the liquid transporter being configured such that the transferring and transporting may occur at a pressure such that the liquid product remains in a stable liquid phase during transfer and transportation.

The liquid transporter may be a vessel. The liquid transporter may be an LPG carrier, such as an LPG vessel. The liquid transporter may be capable of transporting the pressurised liquid product. The liquid transporter may be capable of transporting the pressurised liquid product at between approximately 1 to 10 bar, preferably 5 to 10 bar, preferably 5 bar. The liquid transporter may be a fully pressurised or partially pressurised liquid transporter, such as a standard or fully pressurised LPG vessel.

The transfer means may comprise a conduit leading from the storage tank to the liquid transporter. The transfer means may comprise a pump for actively transferring the liquid. Alternatively, no pump may be provided and the liquid can be transferred passively.

The system may comprise: a second transfer means for transferring the liquid product from the liquid transporter to the other location, the second transfer means being configured such that the transferring may occur at a pressure such that the liquid product remains in a stable liquid phase during transfer; and another means for reducing the pressure of the liquid product to atmospheric pressure at the other location.

The second transfer means may comprise a conduit leading from the liquid transporter to the other location. The second transfer means may comprise a pump for actively transferring the liquid. Alternatively, no pump may be provided and the liquid can be transferred passively.

The well, the pressure reducing means, the separating means, the storage tank and/or the first transfer means may be offshore, preferably subsea. The other location may be an onshore location. The onshore location may comprise a second storage tank.

The pressure reducing means may be any means for reducing the pressure, such as one or more valve(s), choke (s) and/or expander(s).

The system may also comprise a cooler at the other location for cooling the liquid product so as to form a stabilised liquid product onshore. The cooler may be upstream or downstream of the pressure reducing means at the other location.

The produced fluid from the well may comprise a gas component and a liquid component. Typically the produced fluid may comprise, or consist of, gaseous hydrocarbons, liquid hydrocarbons and water. The liquid hydrocarbons may be oil and/or may be condensates and/or LPG. The condensate may be a natural gas condensate.

The system may comprise a separator for separating the gas phase from the liquid phase.

A plurality of separators may be used to separate the gas component from the liquid component.

The produced fluid may be separated using a separator. The separator may separate the gas phase from the liquid phase. The separator may separate gaseous hydrocarbons and gaseous water from liquid hydrocarbons and liquid water. The gaseous hydrocarbons may comprise natural gas and/or petroleum gas. The liquid hydrocarbons may comprise oils, light oils and/or condensates.

The separator may be connected to the well via a spool, such as a rigid or flexible spool. The separator may be connected to a production riser connected to the well via a spool, such as a rigid or flexible spool. The separator may be connected to the storage tank via at least one spool, such as a rigid or flexible spool.

Prior to entering the separator, the produced fluid is reduced in pressure and may have been pre-cooled and/or may have had sediment/sand/mud removed from it. Thus, the system may comprise a pre-cooler and/or a sediment/sand/mud separator upstream of the separator, and upstream and/or downstream of the pressure reducing means. This may improve the separation of natural gas and petroleum gas from condensates and water. The produced fluid may be the pure well stream.

The separator may be a first separator.

The system may comprise a cooler downstream of the first separator connected to the gas product output of the first separator. The system may comprise a second separator downstream of the first separator connected to the gas product output of the first separator. The second separator may preferably be downstream of the cooler.

The separated gas product may pass to the second separator, preferably via the cooler. The cooler and/or second separator may act to purify natural gas by condensing any remaining water or petroleum gas out of the gas component. The cooled gas product (which may now comprise liquids) may then pass through the second separator to separate the condensed liquid from the gas. The condensed (liquid) water and condensed (liquid) petroleum gas can be fed into the separated liquid product output from the first separator. The condensed liquid water and liquid petroleum gas is preferably fed into the separated liquid product upstream of the third separator (see below). Alternatively, however, the condensed liquid can be fed into the separated liquid component downstream of third separator (see below).

The cooler and/or second separator may be connected to the first separator via a spool, such as a rigid or flexible spool. A gas riser may be connected to the gas output of the first separator and/or cooler and/or the second separator for transporting the gas from the seabed to the surface, e.g. to a platform such as an unmanned wellhead platform.

The cooler and/or the second separator may be connected to the liquid output of the first separator via a spool, such as a rigid or flexible spool.

The cooler may be an active cooler or a passive cooler.

The system may comprise a third separator downstream of the first separator connected to the liquid product output of the first separator. The system may comprise a choke or expander or valve downstream of the first separator connected to the liquid component output of the first separator. The third separator may preferably be downstream of the choke or expander or valve.

The separated liquid product output from the first separator may have further gas components (e.g. natural gas) removed from it, preferably using the third separator. This may be achieved by reducing the pressure of the separated liquid product output from the first separator, e.g. using the expander, to allow the gas to evaporate. The pressure may be reduced to between approximately 1 to 10 bar, preferably 5 to 10 bar, preferably 5 bar. This gas may then be separated from the liquid using the third separator, which may be for example the separating apparatus shown in WO 2015/118072.

The gas output of the third separator may be connected to the gas output from the first separator, either upstream or downstream of the cooler and/or second separator, or into the cooler and/or second separator.

The system may comprise an ejector for increasing the pressure of the gas output from the third separator. The ejector may be used to feed the gas output from the third separator into the gas output from the first/second separator or the produced fluid. Additionally/alternatively, a compressor may be used to recompress the gas product output from the third separator, such that it may be fed into the gas output from the second separator and/or the produced fluid. The ejector may be a two or three-set ejector.

The system may comprise a conduit for transporting the purified gas product (i.e. the gas product downstream of the first separator and preferably downstream of the cooler, the second separator and/or ejector/compressor). The conduit may take the gas onshore, or back to a host, or to a drying system, or to a (subsea) compressor, or to a riser, or to a platform. The system may therefore comprise any of these features.

The pressure-reducing means may comprise one or more valve/choke(s) or expander(s). The pressure-reducing means may be located upstream and/or downstream of the first separator. It may be connected downstream of the first separator and may be configured to receive the liquid product from the liquid output of the first separator. The pressure-reducing means may be between the first and third separators and/or upstream of the first separator. The system may comprise a heat exchanger downstream of the separating means. The heat exchanger may be arranged to control the temperature of the liquid product. The system may comprise a pump downstream of the separating means. The pump may be arranged to pump the liquid product. The pump may be downstream of the heat exchanger. The pump and/or the heat exchanger may be upstream of the storage tank. The pump may be used to pump the liquid product into the storage tank. The heat exchanger may heat or cool the liquid product to the desired storage temperature.

Thus, the liquid product may pass through the heat exchanger, which may be a cooler or a heater, and/or the pump and into the storage tank. The heat exchanger may be connected to the (first) separator or the choke or expander or the third separator via a spool, such as a rigid or flexible spool. The heat exchanger may be an active or passive heat exchanger, preferably an active or a passive cooler.

The system may comprise a (second) pump for transferring the liquid product from the storage tank to the transporter. Preferably, however, the transfer may occur passively.

The storage tank may comprise a bladder-type storage tank, such as the Kongsberg storage tank. The storage tank may comprise a concrete storage tank.

The storage tank may have a volume between approximately 1000 $m^3$ and 50000 $m^3$, preferably between approximately 5000 $m^3$ and 10000 $m^3$, and preferably approximately 7500 $m^3$. These volumes are preferable so as to allow for several days or weeks of production from the well before the storage tank is full. Further, these volumes may approximately match the volume of a typical transporter, such as an LPG vessel. The volume of a typical transporter may be between approximately 1000 $m^3$ and 30000 $m^3$, preferably between approximately 5000 $m^3$ and 25000 $m^3$, and preferably approximately 22500 $m^3$.

The system may comprise a conduit connected to the storage tank for transferring the stored liquid product to the liquid transporter. Preferably, the conduit is connected to the top or to the bottom of the tank. The (second) pump may be connected to the conduit.

The storage tank may preferably be located subsea, such as on the sea bed. Alternatively, however, the storage tank could be provided on the sea surface.

At least part of the separating means may be located at a subsea location, such as the seabed. For instance, the (first) separator, the cooler, the second separator, the heater, the valve/choke or expander and/or the third separator may be located subsea. Alternatively, at least part of the separating step may be performed at a topside location.

Thus, the means for pressurising (e.g. maintaining under pressure) the liquid product and the storage tank may be located offshore. The storage tank may be located at a subsea location. The liquid product may be stored under pressure using the pressure of the environment surrounding the storage tank.

At least some of the processing equipment of the system may be located at a subsea location. For instance, the (first) separator, the cooler, the second separator, the choke/valve/expander and/or the third separator may be located subsea. Further, the heat exchanger and/or pump may be located subsea. The choke/expander and/or the third separator may be located subsea. Alternatively, at least part of these components may be located at a topside location. Preferably, the system may be configured such that the liquid remains subsea from the well to the storage. The gas may be sent topside. This allows the well to operate at lower pressures.

The ejector/compressor may preferably be located subsea, but may be located topside.

The subsea components may be at a depth of around 50 m to 10000 m, preferably around 70 m to 1000 m.

The ejector/compressor may be mounted on the (first) separator. The choke or expander may be mounted on the (first) separator. The choke or expander may be mounted on the cooler. The ejector/compressor may be mounted on the cooler. The choke or expander may be mounted on the second separator. The ejector/compressor may be mounted on the second separator. The choke or expander may be mounted on the third separator. The ejector/compressor may be mounted on the third separator. The choke or expander may be mounted on the heat exchanger. The third separator may be mounted on the heat exchanger. The (first) separator, the cooler, the second separator, the ejector/compressor, the choke or expander, the third separator and/or the heat exchanger may be physically attached to each other in one integral unit. The pump may be mounted to the storage tank, or may be separate from the storage tank. The (first) separator, the cooler, the second separator, the ejector/compressor, the choke or expander, the third separator, the heat exchanger and/or the pump may by mounted to the storage tank, or may be separate from the storage tank. Alternatively at least some of these components may be connected via spools, as discussed above. The spools may by approximately 50 m in length.

The first, second, third or fourth separator may be horizontal separator, a vertical separator, a spherical separator, a scrubber, a cyclone scrubber or a gas-liquid cylindrical cyclone separator (GLCC) or the separating apparatus shown in WO 2015/118072.

Certain preferred embodiments will now be described by way of example only with reference to the accompanying drawings in which.

Figure 1:
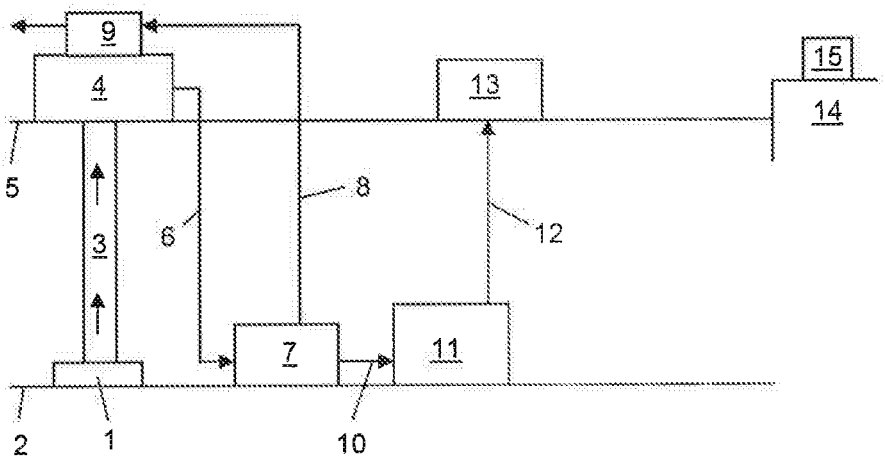
FIG. 1 shows a first embodiment of the present invention.

Regarding FIG. 1, this shows a wellhead 1 of a gas-condensate field on the sea bed 2. The pure well stream passes through riser 3 to unmanned wellhead platform (UWP) 4 on the sea surface 5. The pure well stream comprises a produced fluid, comprising water, natural gas and light liquid hydrocarbons, and sediments such as sand and mud. The sediments may be removed from the pure well stream at the UWP 4.

The produced fluid passes from the UWP 4 to a means for creating a semi-stabilised liquid product 7 that is located on the seabed 2 via a flexible spool 6. A pure gas stream separated from the produced fluid may be output from the means for creating a liquid product 7 through a flexible spool 8. The flexible spool 8 delivers the purified gas stream to gas processing equipment 9 on the UWP 4. The gas processing equipment 9 may comprise a compressor or a pump and may be used to transport the gas to a host or onshore via a gas pipeline.

A semi-stabilised liquid product stream separated from the produced fluid may be output from the means for creating a liquid product 7 through flexible spool 10. The liquid product comprises all non-gaseous components of the produced fluid, e.g. water, LPG and light oils, and may include some components that would be gaseous under atmospheric conditions. The flexible spool 10 delivers the semi-stabilised liquid product to a subsea storage tank 11. Since the storage tank 11 is subsea, it stores the liquid product under pressure, the pressure being generated by the hydrostatic pressure of the local environment. This hydrostatic pressure is used to maintain the semi-stabilised liquid product in a stable state. Between the means for creating a liquid product 7 and the storage tank 11 there may be a heat exchanger and/or a pump (not shown).

A transfer conduit 12 connects the storage tank 11 to the sea surface 5. The transfer conduit 12 may be permanently present. However, the transfer conduit 12 need not always be present since the storage tank 11 can collect the liquid product over a period of days or weeks without being emptied. However, when it is desired to empty the storage tank 11, the transfer conduit 12 allows for transfer of the liquid product from the storage tank 11 to a vessel 13 on the sea surface 5.

The vessel 13 maintains the semi-stable liquid product in a stable state by maintain the liquid product under pressure. The vessel 13 may be used to transfer the stable liquid onshore 14. Again, the liquid product may be maintained under pressure during this step such that it remains in a stable state. The liquid product can then be transferred to onshore processing equipment 15 which may reduce the pressure of the liquid product and perform further separation of the gas and liquid phases produced by the further pressure reduction, so as to form a fully stabilised liquid product at atmospheric pressure.

Figure 2:
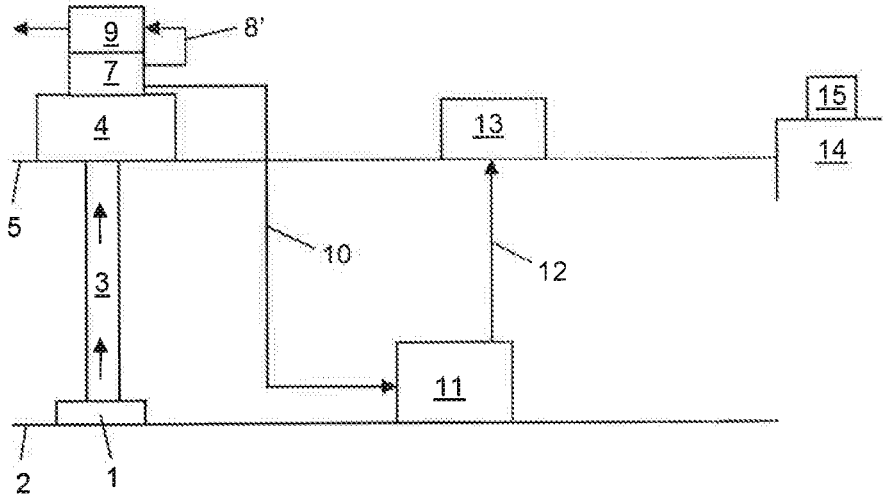
FIG. 2 shows another embodiment of the present invention.

Regarding FIG. 2, this shows a wellhead 1 of a gas-condensate field on the sea bed 2. The pure well stream passes from the wellhead 1 through riser 3 to unmanned wellhead platform (UWP) 4 on the sea surface 5. The pure well stream comprises a produced fluid, comprising water, natural gas and light liquid hydrocarbons, and sediments such as sand and mud. The sediments may be removed from the pure well stream at the UWP 4.

The produced fluid passes to a means for creating a liquid product 7 that is located on UWP 4. A pure gas stream separated from the produced fluid may be output from the means for creating a liquid product 7 through a conduit 8'. The conduit 8' delivers the pure gas stream to gas processing equipment 9 on the UWP 4. The gas processing equipment 9 may comprise a compressor or a pump and may be used to transport the gas to a host or onshore via a gas pipeline.

A semi-stabilised liquid product stream separated from the produced fluid may be output from the means for creating a liquid product 7 through flexible spool 10. The liquid product comprises all non-gaseous components of the produced fluid, e.g. water, LPG and light oils, and may include some components that would be gaseous under atmospheric conditions. The flexible spool 10 delivers the semi-stabilised liquid product to a subsea storage tank 11. Since the storage tank 11 is subsea, it stores the liquid product under pressure, the pressure being generated by the hydrostatic pressure of the local environment. This hydrostatic pressure is used to maintain the semi-stable liquid product in a stable state. Between the means for creating a liquid product 7 and the storage tank 11 there may be a heat exchanger and/or a pump (not shown).

A transfer conduit 12 connects the storage tank 11 to the sea surface 5. The transfer conduit 12 may be permanently present. However, the transfer conduit 12 need not always be present since the storage tank 11 can collect the liquid product over a period of days or weeks without being emptied. However, when it is desired to empty the storage tank 11, the transfer conduit 12 allows for transfer of the liquid product from the storage tank 11 to a vessel 13 on the sea surface 5.

The vessel 13 maintains the semi-stabilised liquid product under pressure in a stable state and may be used to transfer the semi-stable liquid onshore 14. Again, the semi-stabilised liquid product may be maintained under pressure during this step such that it remains in a stable state. The semi-stabilised liquid product can then be transferred to onshore processing equipment 15 which may reduce the pressure of the liquid product and perform further separation of the gas and liquid phases produced by the further pressure reduction, so as to form a fully stabilised liquid product.

Figure 3:
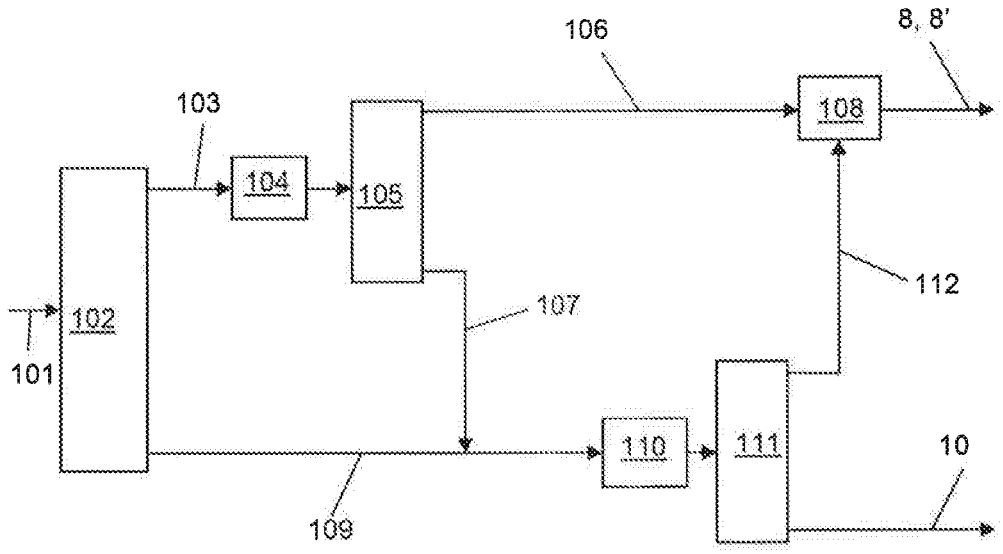
FIG. 3 shows another embodiment of the present invention.

Regarding FIG. 3, this shows in more detail the means for creating a semi-stabilised liquid product 7. The produced fluid enters a first separator 102 through a first conduit 101.

The produced fluid exiting the well typically is at high pressure and temperature. The produced fluid comprises gas and liquid components (i.e. components that would be gas and liquids at atmospheric conditions), but due to the high pressure the produced fluid is a liquid. Upstream of the first separator 102, the produced fluid is cooled and has its pressure reduced. This forms a gas phase and a liquid phase upstream of the first separator 102. The first separator 102 separates the gas phase of the reduced-pressure produced fluid from the liquid phase of the reduced-pressure produced fluid, thus forming a first gas product and a first liquid product.

The gas product is output through a second conduit 103 and passes to a cooler 104 that cools the gas, thus allowing any remaining heavy hydrocarbons to liquefy. The cooled gas product is then fed into a second separator 105 that separates the gas from the liquefied remaining hydrocarbons. The purified gas product is output from the second separator 105 through conduit 106 to an ejector 108. The remaining heavy hydrocarbons are output from the second separator 105 though conduit 107.

The liquid product of the produced fluid separated in the first separator 102 is output from the first separator 102 through conduit 109. Conduit 107 joins conduit 109 upstream of a choke or expander 110. Thus, substantially all liquid components of the produced fluid are fed into the choke or expander 110. The choke or expander 110 is used to reduce the pressure of the liquid. Further, reducing the pressure of the liquid allows for any remaining gas components in the liquid to evaporate out of the liquid. The reduced-pressure liquid and gas combination passes into a third separator 111. The pressure at this stage is low, but above atmospheric pressure, such as 1 to 10 bar.

The third separator 111 outputs the evaporated gas as a second gas product through conduit 112. The gas passes through conduit 112 to the ejector 108. The ejector combines the low pressure gas in conduit 112 with the high pressure gas in conduit 106. The combined gas leaves the ejector through flexible spool 8 or conduit 8', as seen in FIGS. 1 and 2. Alternatively to an ejector, a compressor could be used to compress the gas product in conduit 112.

The third separator 111 outputs the purified liquid product through flexible spool 10. The liquid in the flexible spool 10 is at a low pressure in comparison to the well pressure, but is at a pressure greater than atmospheric pressure. The liquid product is maintained at a pressure such that it is in a stable liquid phase.

Further, due to the two-stage separation and feedback of the gas stream and the liquid stream, the gas product output from the ejector 108 comprises substantially all of the gas components in the produced fluid and the liquid output from the third separator 111 comprises substantially all of the liquid components in the produced fluid.

The unstable liquid product output from third separator 111 is stored in storage tank 11 where it is maintained in a stable state by being stored under pressure generated by the hydrostatic pressure of the surrounding sea environment. In order for the low pressure liquid product exiting the third separator 111 to be able to enter the pressurised storage tank 11, a pump may be provided between the third separator and the storage tank 11. Further, in order to store the liquid product at the correct temperature (e.g. in order to maintain the semi-stable liquid product in a stable state) a heat exchanger may be provided between the third separator 111 and the storage tank 11. The heat exchanger may heat or cool the liquid product as necessary.

The invention claimed is:

1. A method of processing a fluid produced from a well, the produced fluid being a high pressure fluid, the method comprising:

reducing the pressure of the fluid to a reduced pressure such that a gas phase and a liquid phase are formed;

separating the gas phase from the liquid phase thus forming a gas product and a liquid product;

storing the liquid product in a storage tank at a pressure such that the liquid product remains in a stable liquid phase during storage, wherein the reduced pressure is greater than atmospheric pressure;

transferring the liquid product from the storage tank to a liquid transporter, wherein the transferring occurs at a pressure such that the liquid product remains in a stable liquid phase during transfer;

transporting the liquid product to another location using the liquid transporter, wherein the transporting occurs at a pressure such that the liquid product remains in a stable liquid phase during transport;

transferring the liquid product to the other location, wherein the transferring occurs at a pressure such that the liquid product remains in a stable liquid phase during transfer; and reducing the pressure of the liquid product to atmospheric pressure.

2. The method as claimed in claim 1, wherein the reduced pressure is greater than 2 bar.

3. The method as claimed in claim 1, wherein the liquid product comprises liquid hydrocarbons and water.

4. The method as claimed in claim 1, wherein the storing step comprises storing the liquid product at a subsea location.

5. The method as claimed in claim 4, wherein at least part of a pressure source for storing the liquid product under pressure is from the environment surrounding the storage tank.

6. The method as claimed in claim 1, wherein the well is an offshore well and the pressure-reducing step, the separating step and the storage step are performed offshore.

7. The method as claimed in claim 1, wherein the pressure-reducing step and the separating step comprises:

reducing the pressure of the produced fluid to a first reduced pressure such that a first gas phase and a first liquid phase are formed;

separating the first gas phase from the first liquid phase to form a first gas product and a first liquid product;

reducing the pressure of the first liquid product to a second reduced pressure such that a second gas phase and a second liquid phase are formed; and separating the second gas phase from the second liquid phase to form a second gas product and a second liquid product, wherein the second liquid product is the stored liquid product, and wherein the first reduced pressure is greater than the second reduced pressure and the second reduced pressure is greater than atmospheric pressure.

8. The method as claimed in claim 7, wherein the second gas product is combined with the first gas product and/or combined with the produced fluid.

9. The method as claimed in claim 1, wherein the pressure-reducing step and the separating step comprises:

reducing the pressure of the produced fluid to a first reduced pressure such that a first gas phase and a first liquid phase are formed;

separating the first gas phase from the first liquid phase to form a first gas product and a first liquid product;

reducing the temperature of the first gas product to a reduced temperature such that a second gas phase and a second liquid phase are formed; and separating the second gas phase from the second liquid phase to form a second gas product and a second liquid product, wherein the second liquid product is combined with the first liquid product, the combined liquid products being stored in the storage tank.

10. The method as claimed in claim 1, wherein at least part of the pressure-reducing step and/or the separating step is performed at a subsea location.

11. The method as claimed in claim 10, comprising sending the gas product to a topside location and maintaining the liquid product at a subsea location.

12. A system for processing a fluid produced from a well, the produced fluid being a high pressure fluid, the system comprising:

means for reducing the pressure of the fluid to a reduced pressure such that a gas phase and a liquid phase are formed;

means for separating the gas phase from the liquid phase thus forming a gas product and a liquid product;

a storage tank for storing the liquid product in a storage tank at a pressure such that the liquid product remains in a stable liquid phase during storage, the means for reducing pressure being configured such that the reduced pressure is greater than atmospheric pressure;

a transfer means for transferring the liquid product from the storage tank; and a liquid transporter for transporting the liquid product, transferred from the storage tank via the transfer means, to another location, the transfer means and the liquid transporter being configured such that the transferring and transporting occurs at a pressure such that the liquid product remains in a stable liquid phase during transfer and transportation.

13. The system as claimed in claim 12, further comprising:

a second transfer means for transferring the liquid product from the liquid transporter to the other location, the second transfer means being configured such that the transferring by the second transfer means occurs at a pressure such that the liquid product remains in a stable liquid phase during transfer; and another means for reducing the pressure of the liquid product to atmospheric pressure at the other location.

14. A method of processing a fluid produced from a well, the produced fluid being a high pressure fluid, the method comprising:

reducing the pressure of the fluid to a reduced pressure such that a gas phase and a liquid phase are formed;

separating the gas phase from the liquid phase thus forming a gas product and a liquid product; and storing the liquid product in a storage tank at a pressure such that the liquid product remains in a stable liquid phase during storage, wherein the reduced pressure is greater than atmospheric pressure, wherein the pressure of the liquid product is maintained at a pressure substantially equal to or greater than the reduced pressure in the separation and/or storage steps.

* * * * *